United States Patent [19]

Webster

[11] Patent Number: 4,863,578

[45] Date of Patent: Sep. 5, 1989

[54] CORRODIBLE LINK FOR CATHODIC PROTECTION SYSTEMS

[75] Inventor: Harold A. Webster, Pickering, Canada

[73] Assignee: Corrosion Service Company Limited, Downsview, Canada

[21] Appl. No.: 185,987

[22] Filed: Apr. 25, 1988

[51] Int. Cl.[4] ..... C23F 13/00

[52] U.S. Cl. ..... 204/197; 204/148

[58] Field of Search ..... 204/148, 197

[56] References Cited

U.S. PATENT DOCUMENTS

| | | | |
|---|---|---|---|
| 629,092 | 7/1899 | Ross | 204/148 |
| 2,620,297 | 12/1952 | Stobie et al. | 204/197 |
| 2,763,907 | 9/1956 | Douglas | 204/197 |
| 3,001,924 | 9/1961 | Battis et al. | 204/197 |
| 3,451,913 | 6/1969 | Laborde et al. | 204/148 |
| 3,629,092 | 12/1971 | George | 204/148 |
| 3,689,395 | 9/1972 | Blount et al. | 204/148 |
| 3,726,779 | 4/1973 | Morgan | 204/197 |

OTHER PUBLICATIONS

*Marine Engineering*, vol. 58, No. 6, Jun. 1953, pp. 69–73.

*Primary Examiner*—T Tung

*Attorney, Agent, or Firm*—Sim & McBurney

[57] ABSTRACT

In a system for cathodically protecting an underground metallic structure where a sacrificial anode material encasing a metal core is in electrical communication with the structure, the core can be automatically and galvanically disconnected from electrical communication with the structure after the anode material has been consumed, by inserting in series between the structure and the core a corrodible link made of a material which is less galvanically active than the anode material but more galvanically active than the material of the core. At least a portion of the corrodible link is exposed to the underground environment, so that upon consumption of the anode material, the corrodible link will corrode and break the connection between the core and the underground structure.

12 Claims, 1 Drawing Sheet

CORRODIBLE LINK FOR CATHODIC PROTECTION SYSTEMS

This invention relates generally to the cathodic protection of underground metallic structures, and has to do particularly with a method and a manufactured article for automatically disconnecting the core of a sacrificial cathodic protection anode from the structure being protected, after the sacrificial anode material has been consumed, the disconnection occurring by electrochemical means.

BACKGROUND OF THIS INVENTION

Sacrificial cathodic protection anodes, typically composed of alloys of magnesium, zinc, and aluminum, are usually connected directly to the structure being protected through a shielded cable or wire. Underground steel pipes are typical of the structures protected against corrosion in this way. Typically, the sacrificial anodic material encases a metallic core of lower galvanic activity than the anodic material, and connection to the anodic material is made through the metallic core. Commonly, the core is of steel, but in some cases copper or other metals can be utilized.

As the cathodic protection current is provided by the sacrificial anode material, the material of the anode is consumed until only the metallic core remains. At this time, the core is a liability to the structure, since it effectively adds additional area which must subsequently be unnecessarily protected. This is particulary important with steel cores, which are used in the majority of cases.

The steel cores left over from expended sacrificial anodes can represent an increasingly high percentage of the total bare area on a coated structure. For this reason, subsequent cathodic protection systems must be increased in capacity to supply current to the bare steel cores. This results in added protection costs in proportion to the amount of core area relative to the structure area. The only present means of avoiding this additional cathodic protection cost is to excavate and disconnect the core wire. However, this is a very costly procedure.

GENERAL DESCRIPTION OF THIS INVENTION

In view of the above discussion, the present invention provides a device which automatically disconnects the anode core from the underground structure after the active anode material has been consumed, the disconnection being made through electrochemical activity.

More particularly, this invention provides a method for use with a system for cathodically protecting an underground metallic structure, in which a sacrificial anode material encasing a metal core is in electrical communication with the structure through said core, the anode material being more galvanically active than the material of said metallic structure, the method ensuring the automatic disconnection of the core from electrical communication with said structure after the anode material has been consumed, the method comprising:

providing an elongate corrodible link having two ends, the link being made of a material which is less galvanically active than the anode material but more galvanically active than the material of said core, connecting one end of the link so as to provide electrical communication between said one end and the core, connecting the other end of the link so as to provide electrical communication between said other end and the metallic structure, whereby all of the electrical current flows through the link, shielding each end of the link from the underground environment, while leaving an intermediate portion of the link exposed to the underground environment, whereby after consumption of the anode material said intermediate portion of the corrodible link will be consumed, thus severing the electrical connection between the core and said structure.

Further, this invention provides a cathodic protection unit adapted for electrical connection to an underground metallic structure, the unit comprising:

a metal core, anodic material encasing the core, the anodic material being more galvanically active than the material of said structure, and an elongate corrodible link having two ends, one end of the link being connected electrically and in series with the core, such that all of the electrical current flows through the link, the link having intermediate its ends an exposed portion adapted to contact the underground environment, the location of connection between said one end and the core being shielded from the underground environment, the link being of a material which is less galvanically active than the anode material but more galvanically active than the material of the core, the link having means for electrical communication with said metallic structure.

GENERAL DESCRIPTION OF THE DRAWINGS

One embodiment of this invention is illustrated in the accompanying drawing, in which like numerals denote like parts throughout the several views, and in which:

FIG. 1 is a perspective view of a pipe and a sacrificial anode for cathodically protecting the pipe, representing the prior art; and FIG. 2 is an axial sectional view through a portion of a protective anode, illustrating the present invention.

DETAILED DESCRIPTION OF THE DRAWINGS

Figure 1:
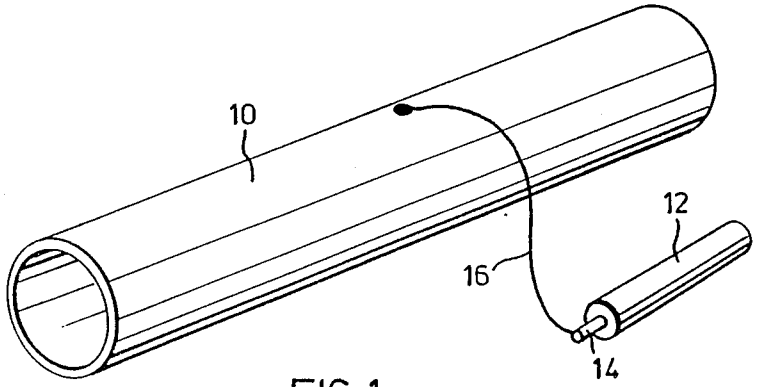
FIG. 1 PRIOR ART

In FIG. 1 there shown a pipe 10, a conventional sacrificial anode 12 with a steel core 14, and a shielded cable 16 electrically connecting the core 14 to the pipe 10. It is to be understood that all of these structures are buried in the ground.

Figure 2:
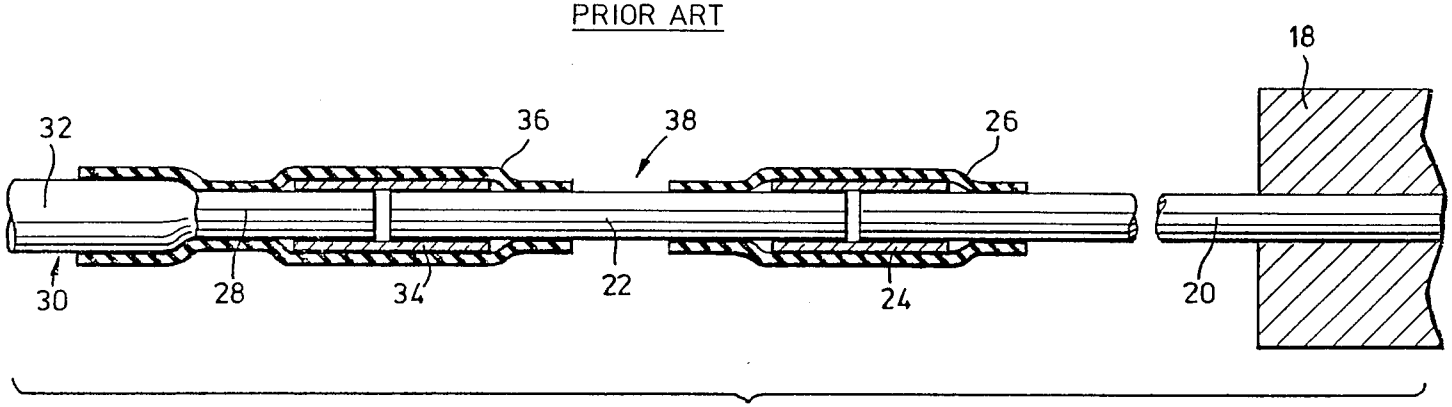

Attention is now directed to FIG. 2, which illustrates the present invention. In FIG. 2, the anodic material 18 is shown encasing a metal (typically steel) core 20. An elongate corrodible link 22 is provided, and one end thereof is securely connected to the end of the core 20 by a crimped and soldered metal sleeve 24. As can be seen, the fusible link 22 and the core 20 are axially aligned, and the connection by way of the sleeve 24 is covered with a further sleeve of insulating material 26.

The other end of the corrodible link 22 is electrically connected to one end 28 of a wire or cable 30 which normally incorporates an insulating sheath 32, and which connects to the underground structure which is to be protected, in the same manner as the wire or cable 16 shown in FIG. 1. The connection between the corrodible link 22 and wire or cable 28 is again by way of a crimped and soldered metal sleeve 34, with the connection being covered by a further sleeve 36 of insulating material. As can be seen in FIG. 2, the sleeve 36 is disposed in such a way as to protect and shield all of the bared portion of the wire or cable 28. It will be noted that the sleeves 26 and 36 are spaced apart, leaving an exposed intermediate region 38 of the corrodible link, where the link can contact the surrounding underground environment.

The corrodible link 22 and the anode material 18 may be encased in a typical packaged anode backfill, such as a mixture of gypsum, bentonite and sodium sulphate or may be left bare to directly contact the surrounding soil or water.

As an alternative, the corridible link 22 may be inserted in the wire or cable 30 closer to the structure which is to be protected, so that both the cable and the anode core are electrochemically disconnected from each other when the corrodible link 22 each consumed due to galvanic activity.

In order to ensure that disconnection takes place, the present invention requires that the corrodible link 22 be composed of a metal or alloy which is less galvanically active than the sacrificial anode alloy material 18, but more galvanically active than the material of the core 20.

Thus, it will be understood that when the anode alloy material 18 has been consumed, the corrodible link 22 will then become the most active portion in terms of galvanic activity, and will begin to corrode. Owing to the small exposed area of the corrodible link 22 compared to the core 20 and the basic structure being protected, as well as the galvanic potential difference, the corrodible link 22 will corrode rapidly, causing the same to be severed in a short period of time and thereby effectively disconneting the anode core 20 from the underground structure being protected.

The use of this device will result in cost savings in the continued cathodic protection of underground structures, since anode cores will no longer drain away a portion of the cathodic protection current. The corrodible link 22 can be incorporated into an anode package, which may if desired incorporate a packaged anode backfill mixture such as gypsum, bentonite and sodium sulphate, or alternatively can be supplied separately for insertion at any desired point in the anode cable in the anode cable, for example at the structure connection end.

EXAMPLES

1. The use of a zinc alloy corrodible link on a magnesium alloy anode having a steel core.
2. The use of a steel alloy corrodible link on a zinc alloy anode having a copper core.
3. The use of a low potential magnesium alloy corrodible link on a high potential magnesium alloy anode having a steel core.
4. The use of a low potential aluminum alloy corrodible link on a high potential aluminum alloy anode having a steel core.

While one embodiment of this invention has been described hereinabove and illustrated in the accompanying drawings, it will be evident to those skilled in the art that changes and modifications may be made therein, without departing from the essence of this invention, as set forth in the appended claims.

The embodiments of the invention in which an exclusive property or privilege is claimed are defined as follows:

1. A method for improving a system for cathodically protecting an underground metallic structure, in which a sacrificial anode material encasing a metal core is in electrical communication with the structure through said core, the anode material being more galvanically active than the material of said metallic structure, the method ensuring the automatic disconnection of the core from electrical communication with said structure after the anode material has been consumed, the method comprising:

providing an elongate corrodible link having two ends, the link being made of a material which is less galvanically active than the anode material but more galvanically active than the material of said core, connecting one end of the link so as to provide electrical communication between said one end and the core, connecting the other end of the link so as to provide electrical communication between said other end and the metallic structure, whereby all of the electrical current flows through the link, shielding each end of the link from the underground environment, while leaving an intermediate portion of the link exposed to the underground environment, whereby after consumption of the anode material said intermediate portion of the corrodible link will be consumed, thus severing the electrical connection between the core and said structure.

2. The method claimed in claim 1, in which the core is steel, the corrodible link is a zinc alloy, and the anode material is a magnesium alloy.

3. The method claimed in claim 1, in which the core is copper, the corrodible link is a steel, and the anode material is a zinc alloy.

4. The method claimed in claim 1, in which the core is steel, the corrodible link is a low potential magnesium alloy, and the anode material is a high potential magnesium alloy.

5. The method claimed in claim 1, in which the core is steel, the corrodible link is a low potential aluminum alloy, and the anode material is a high potential aluminum alloy.

6. A cathodic protection unit adapted for electrical connection to an underground metallic structure, the unit comprising:

a metal core, anodic material encasing the core, the anodic material being more galvanically active than the material of said structure, and an elongate corrodible link having two ends, one end of the link being connected electrically and in series with the core, such that all of the electrical current flows through the link, the link having intermediate its ends an exposed portion adapted to contact the underground environment, the location of connection between said one end and the core being shielded from the underground environment, the link being of a material which is less galvanically active than the anode material but more galvanically active than the material of the core, the link having means for electrical communication with said metallic structure.

7. The unit claimed in claim 6, in which the link has means for connection to a cable which can in turn be connected to said metallic structure.

8. The unit claimed in claim 6, in which the core is steel, the corrodible link is a zinc alloy, and the anode material is a magnesium alloy.

9. The unit claimed in claim 6, in which the core is copper, the corrodible link is a steel, and the anode material is a zinc alloy.

10. The unit claimed in claim 6, in which the core is steel, the corrodible link is a low potential magnesium alloy, and the anode material is a high potential magnesium alloy.

11. The unit claimed in claim 6, in which the core is steel, the corrodible link is a low potential aluminum alloy, and the anode material is a high potential aluminum alloy.

12. The unit claimed in claim 6, in which the means for electrical connection with said metallic structure is a shielded cable, and the connection between the corrodible link and the cable is shielded from contact with the underground environment.

* * * * *